United States Patent [19]

Brasch et al.

[11] Patent Number: 4,633,607

[45] Date of Patent: Jan. 6, 1987

[54] MULTIPLE AXIS HINGED DISPLAY ASSEMBLY

[75] Inventors: Miles E. Brasch; Allan G. Campbell, III, both of Bloomfield Hills, Mich.

[73] Assignee: A.R. Brasch Advertising, Inc., Southfield, Mich.

[21] Appl. No.: 650,255

[22] Filed: Sep. 13, 1984

[51] Int. Cl.[4] ..... G09F 19/00

[52] U.S. Cl. ..... 40/530; 40/539

[58] Field of Search ..... 40/530, 539, 124.1

[56] References Cited

U.S. PATENT DOCUMENTS 2,833,074 5/1958 Jannes ..... 40/539

4,095,386 6/1978 Johnson ..... 40/539

4,462,178 7/1984 Freeman ..... 40/124.1

*Primary Examiner*—Gene Mancene

*Assistant Examiner*—Wenceslao J. Contreras

*Attorney, Agent, or Firm*—Gifford, Groh, VanOphem, Sheridan, Sprinkle & Dolgorukov

[57] ABSTRACT

A display assembly having four and preferably eight substantially identical geometric units wherein each unit has a plurality of planar faces adapted to contain display indicia. The units are pivotally secured to each other about their edges so that, by pivotting the units with respect to each other, the display unit assumes a number of different configurations and, in doing so, selectively covers and exposes the indicia bearing faces.

5 Claims, 6 Drawing Figures

MULTIPLE AXIS HINGED DISPLAY ASSEMBLY

BACKGROUND OF THE INVENTION

I. Field of the Invention

The present invention relates generally to display assemblies and, more particularly, to a display assembly having a plurality of indicia bearing faces.

II. Description of the Prior Art

The goal for all display assemblies containing advertising or promotional material is both to obtain and retain the attention of the customer or person to which the advertising is directed. The previously known display assemblies have heretofore relied almost exclusively on the advertising or promotional material to attract the attention of the customer rather than the display assembly itself.

SUMMARY OF THE PRESENT INVENTION

The present invention provides a display assembly for advertising or promotional material which both attracts and retains the attention of the customer or other person to whom the promotional material is directed.

In brief, the display assembly of the present invention comprises at least four and preferably eight substantially identical geometrical units wherein each unit has a plurality of planar faces each of which is adapted to contain advertising indicia. Preferably, each geometric unit comprises one half of a right parallelepiped.

The geometric units are pivotally secured to each other about their edges so that, by pivoting the units, the indicia bearing faces are selectively covered or exposed. Furthermore, by pivoting the units with respect to each other, the display assembly can assume a plurality of different configurations. Since rearranging the display assembly into different configurations is entertaining, the display assembly both captures and retains the attention of the potential customer.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
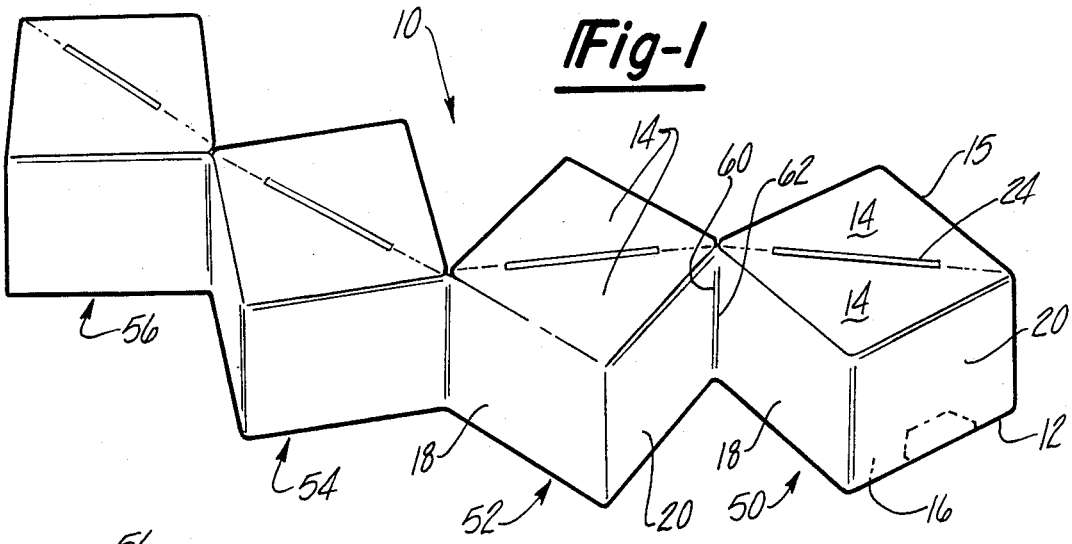
FIG. 1 is a perspective view illustrating a preferred embodiment of the present invention.

With reference first to FIG. 1, the preferred embodiment of the display assembly 10 of the present invention is thereshown and comprises four subassemblies 50, 52, 54 and 56 which are substantially identical to each other. Consequently, only the subassembly 50 will be described in detail, it being understood that a like description shall also apply to the other subassemblies 52–56.

Figure 2:
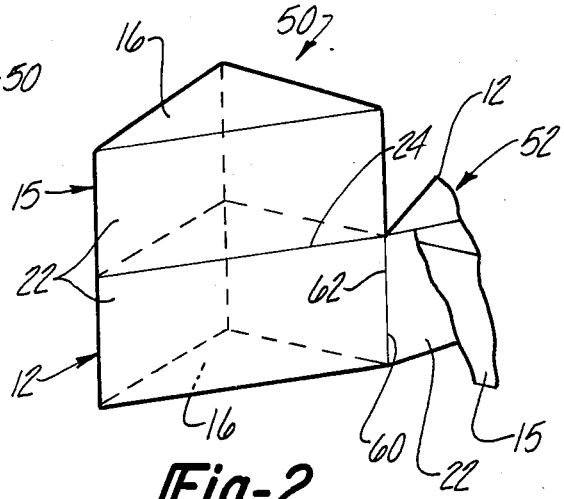
FIG. 2 is a rear view illustrating one component of the preferred embodiment of the present invention.

With reference now to FIGS. 1 and 2, the subassembly 50 is constructed from two geometric units 12 and 15 which are also substantially identical to the other and preferably each comprise one half of a right parallelepiped. As such, each unit 12 or 15 includes a top 14 and a bottom 16 (as viewed in FIG. 1) which are triangular in shape and spaced apart but parallel to each other. Two small rectangular sides 18 and 20 (FIG. 1) extend perpendicularly between the top 14 and bottom 16 and lie in perpendicular planes with respect to each other. In addition, a large or diagonal rectangular side 22 (FIG. 2) of each unit 12 or 15 lies in a plane perpendicular to the plane of the top 14 and bottom 16 and interconnects the free ends of the sides 18 and 20.

The top 14, bottom 16 and each side 18–22 or face of each unit 12 or 15 are generally planar and are adapted to contain advertising or promotional indicia.

With reference still to FIGS. 1 and 2, in the subassembly 50 the edge 24 formed by the intersection of the diagonal side 22 and top 14 of the unit 12 is pivotally secured to the corresponding edge on the second unit 15. The units 12 and 15 are thus pivotal with respect to each other from the position shown in FIG. 1 in which the diagonal sides 22 on the units 12 and 15 flatly abut against each other and to the position shown in FIG. 2, in which the tops 14 on the two units 12 and 15 flatly abut against each other.

Figure 3:
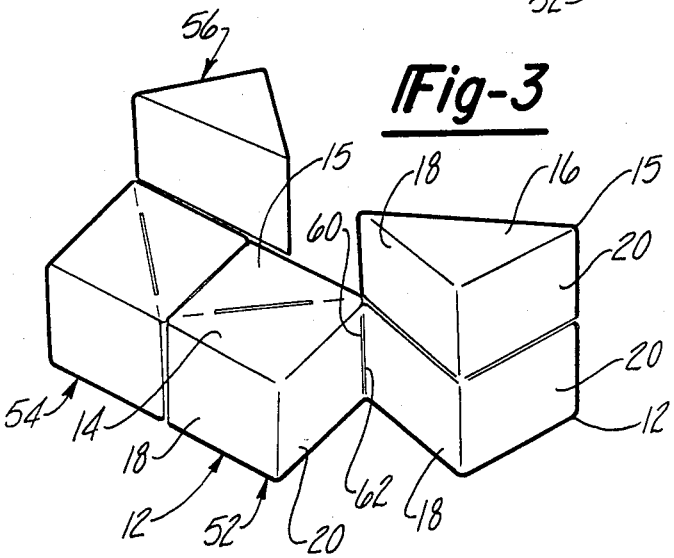
FIGS. 3–5 are perspective views illustrating some of the different configurations of the preferred embodiment of the present invention.

With reference now to FIGS. 1–3, the first subassembly 50 is pivotally secured to the second subassembly 52, the second subassembly 52 is pivotally secured to the third subassembly 54 and, similarly, the third subassembly 54 is pivotally secured to the fourth subassembly 56. More specifically, the edge 62 formed by the intersection of the diagonal side 22 and one rectangular side 18 on the unit 12 of the first subassembly 50 is pivotally secured to the edge 60 formed by the intersection of the diagonal side 22 and the other rectangular side 20 of the unit 12 of the second subassembly 52. The second and third subassemblies 52 and 54 as well as the third and fourth subassemblies 54 and 56 are pivotally secured together in the identical fashion as the first and second subassemblies 50 and 52.

Figure 4:
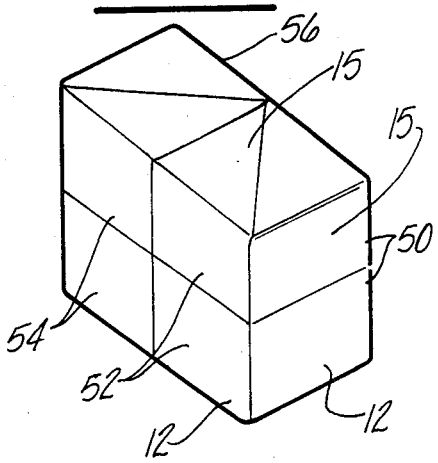
Figure 5:
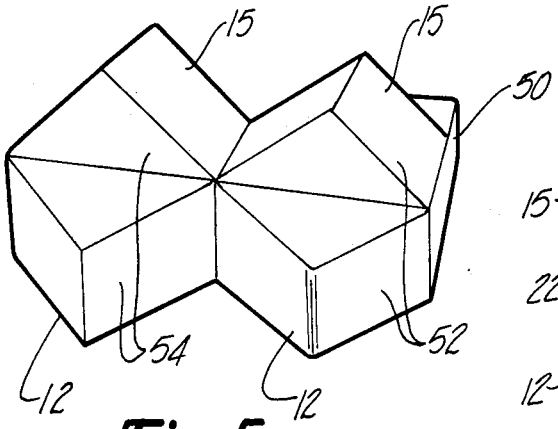

The pivotal attachments between the subassemblies 50–56 allow, for example, the subassemblies 50–56 to pivot from the position shown by the subassemblies 52 and 54 in FIG. 3, in which the small rectangular sides 18 and 20 on the units 12 of adjacent subassemblies flatly abut against each other, and to the position shown in FIG. 4, in which the diagonal sides 22 of both units 12 and 15 of one subassembly respectively, flatly abut against the diagonal sides 22 of the units 12 and 15 on the adjacent subassembly. Furthermore, it will be understood that the pivotal attachment between the subassemblies 50–56, as well as the pivotal attachment between the units 12 and 15 in each subassembly, are completely independent of each other.

The pivotal attachment between the subassemblies 50–56 as well as between the units 12 and 15 in each subassembly, allow the display assembly of the present invention to assume a number of different orientations or configurations. Some examples of the different configurations are shown in FIGS. 1, 3, 4 and 5. Furthermore, since the various faces are selectively covered and uncovered by rearranging the display assembly in different positions, a plurality of different advertising messages can be contained on a single display assembly.

Figure 6:
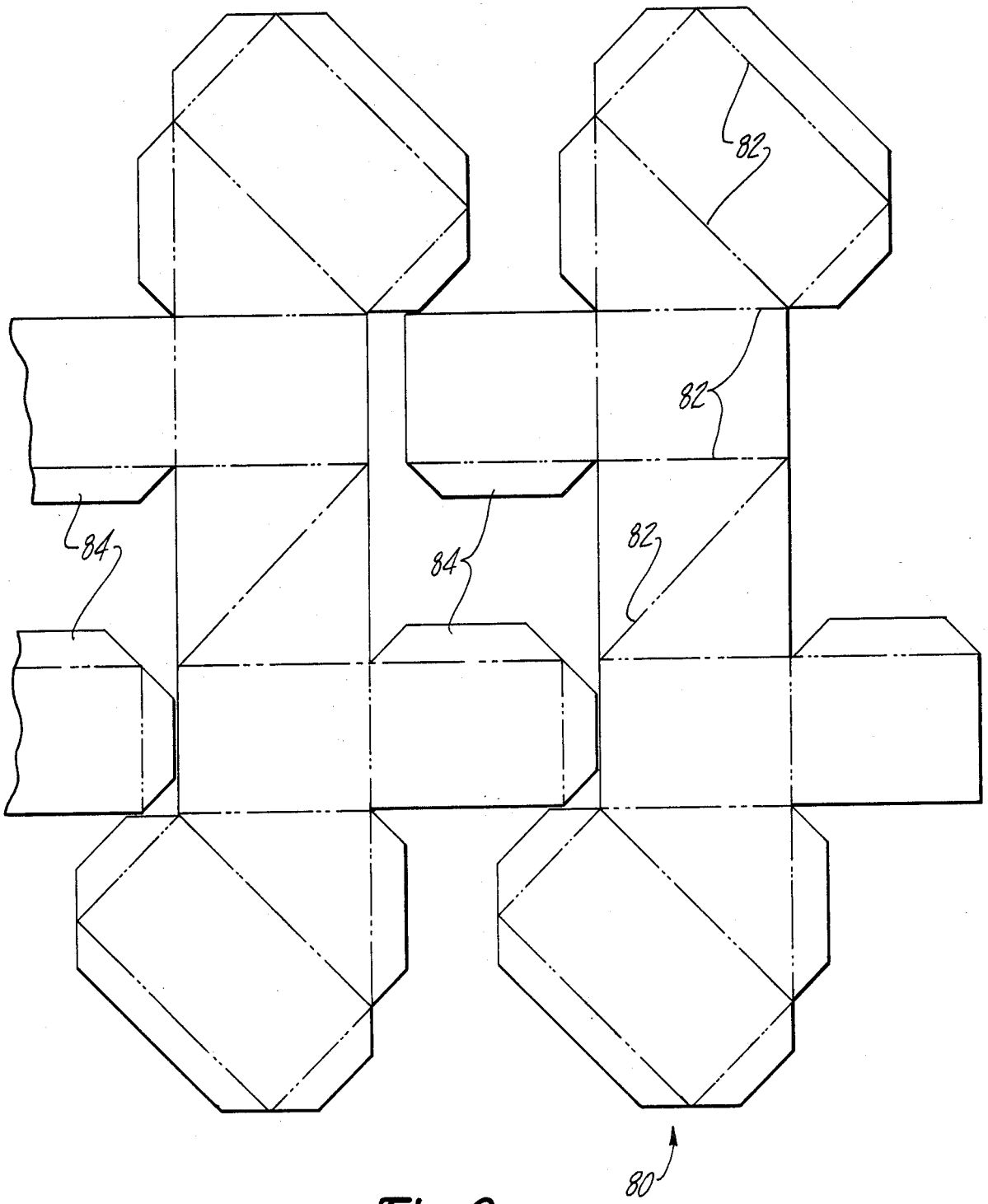
FIG. 6 is a fragmentary plan view illustrating a blank for constructing the preferred embodiment of the present invention.

With reference now to FIG. 6, the entire display assembly 10 is preferably constructed from a single piece blank 80. The blank 80 is preferably made of cardboard and is stamped with a number of fold lines 82 for forming the subassemblies 50–56 as well as the geometric units 12 and 15 in each subassembly 50–56. In order to retain the assembly together after folding, the blank 80 includes locking tabs 84 which are secured to corresponding portions of the blank 80 by glue, staples or the like.

A primary advantage of the display assembly of the present invention is that it includes forty different faces or sides, each of which can contain a different advertising message or other indicia. In addition, since it is entertaining to rearrange the display assembly in its different configurations, the assembly of the present invention not only attracts the attention of a potential customer or person to whom the advertising message is directed, but also retains that attention for an extended period of time. During all of the time that the potential customer rearranges the assembly in its different configurations, he or she is subjected to the advertising messages in the desired fashion.

Although in the preferred embodiment of the invention the display assembly includes four subassemblies, it can alternatively be constructed from only two subassemblies. In the latter case, the display assembly would have only twenty indicia bearing faces.

Having described my invention, however, many modifications thereto will become apparent to those skilled in the art to which it pertains without deviation from the spirit of the invention as defined by the scope of the appended claims.

We claim:

1. A display assembly comprising:

at least two substantially identical subassemblies, means for pivotally securing said subassemblies together about a first pivotal axis, wherein each subassembly comprises two substantially identical geometric units, each unit having a plurality of indicia bearing surfaces, each of said surfaces being planar, means for pivotally securing said geometric units together in each subassembly about a second pivotal axis, said first and second pivotal axes being perpendicular to each other, wherein said means for pivotally securing said subassemblies together comprises means for pivotally securing only one unit of one subassembly to only one unit of the other subassembly about said first pivotal axis, and wherein the faces of said units are selectively covered and exposed by pivoting said units about said second axis into different positions with respect to each other and by pivotting said subassemblies about said first axis into different positions with respect to each other.

2. The invention as defined in claim 1 wherein each unit comprises one half of a right parallelpiped.

3. The invention as defined in claim 1 wherein said second mentioned pivotal securing means pivotally secures an edge of said one unit for each subassembly to a further edge of the other unit for each subassembly.

4. The invention as defined in claim 1 and comprising at least four substantially identical subassemblies, said subassemblies being adjacent each other, and means for pivotally securing each subassembly to its adjacent subassembly or subassemblies.

5. The invention as defined in claim 1 wherein said display assembly is constructed from a single piece blank.

* * * * *